US005163859A

United States Patent [19]

Beltrani et al.

[11] Patent Number: 5,163,859

[45] Date of Patent: Nov. 17, 1992

[54] SWIMMING FLIPPER WITH A COMPOSITE BLADE AND A METHOD FOR ITS MANUFACTURE

[75] Inventors: Gianni Beltrani, Genova; Mirko Bosio, Aosta, both of Italy

[73] Assignee: Technisub S.p.A., Genoa, Italy

[21] Appl. No.: 639,865

[22] Filed: Jan. 11, 1991

[30] Foreign Application Priority Data

Jan. 12, 1990 [IT] Italy ..... 67028 A/90

[51] Int. Cl.[5] ..... A63B 31/11

[52] U.S. Cl. ..... 441/64; 441/61

[58] Field of Search ..... 441/64, 63, 61, 62; D21/238, 239; 440/15

[56] References Cited

U.S. PATENT DOCUMENTS

| | | | |
|---|---|---|---|
| 2,588,363 | 3/1952 | Corlieu . | |
| 3,922,741 | 12/1975 | Semeia | 441/64 |
| 4,820,218 | 4/1989 | Van de Pol | 441/64 |
| 4,954,111 | 9/1990 | Cressi | 441/64 |
| 4,954,112 | 9/1990 | Negrini | 441/64 |

FOREIGN PATENT DOCUMENTS

| | | |
|---|---|---|
| 0308998 | 6/1989 | European Pat. Off. . |
| 3438808 | 4/1986 | Fed. Rep. of Germany . |
| 2058941 | 5/1971 | France . |
| 2213072 | 2/1974 | France . |

*Primary Examiner*—Edwin L. Swinehart

*Attorney, Agent, or Firm*—Sughrue, Mion, Zinn, Macpeak & Seas

[57] ABSTRACT

A swimming flipper includes a blade of fairly rigid thermoplastic material and a shoe of elastomeric material or soft thermoplastic rubber. The blade has a partially multi-layered structure including a base layer made of the fairly rigid thermoplastic material and a partial outer layer of a more resilient material which is superimposed on and connected permanently to the base layer.

23 Claims, 3 Drawing Sheets

SWIMMING FLIPPER WITH A COMPOSITE BLADE AND A METHOD FOR ITS MANUFACTURE

BACKGROUND OF THE INVENTION

The present invention relates to a swimming flipper including a blade of fairly rigid thermoplastic material and a shoe of elastomeric material or soft thermoplastic rubber fixed to the blade.

According to the prior art, the shoe is attached to the blade by various means such as gluing, mechanical assembly or the like. For some time now, however, the manufacturing technology which has been found to be successful for producing flippers of this type consists firstly of the injection moulding of the blade from a semi-rigid thermoplastic material with a low melting point, normally E.V.A. (ethylene vinyl acetate). The shoe is then moulded over one end of the pre-moulded blade, normally with the use of a thermoplastic rubber which has a considerable chemical affinity for E.V.A. and a higher melting point. The thermoplastic rubber is admitted to the die at a temperature high enough to melt the surface of the blade in the region in which the shoe is formed so that the materials of the shoe and the blade are welded and stuck together by a chemical-thermal effect.

The main disadvantages of these known flippers are as follows.

1. In the first place, it is difficult to attain the correct resilient behaviour of the blade in order to achieve the most effective possible propulsion in use. In fact, as is known, the blade must retain its precise geometrical shape (known as "zero deformation") and must be able to bend with controlled rigidity, assuming very regular deformation curves. Moreover, once released, it should snap back precisely to its "zero deformation" condition. Now, precisely because the materials (E.V.A) normally used for its manufacture have a certain rigidity so as to retain their shape, they are not very resilient, that is, they are only extensible by very small percentages. Moreover, once deformed, they do not return spontaneously to their "zero deformation" conditions. They therefore spring back incompletely and in any case very slowly. Rubbery materials which snap back precisely and completely, on the other hand, do not retain their shape and, for this reason, they are not now used to make blades.
2. The materials (E.V.A.) used today for producing blades are not at all resistant to abrasion. As a result, the blade of a flipper becomes scratched and cut after a few hours' use and deteriorates considerably both functionally and aesthetically. It is known that, for this reason, flippers with E.V.A. blades have very short average lives.
3. The surface of an E.V.A. blade cannot be coloured or painted permanently (hot-printing, silk-screen printing, stamping). It is therefore not possible, in practice, to have two-tone, multi-tone or decorated blades.
4. E.V.A. blades are extremely temperature-sensitive: in cold water they become too stiff, in hot water too flexible.
5. In order not to extend moulding times and to avoid conspicuous deformities (shrinkage cavities), the thickness of the blade must be homogeneous and may not exceed certain values. For this reason, it is difficult to achieve certain effects with varying cross-sections of different bending resistances.
6. The outer edges of the blade, which are of a fairly rigid material and thus have to be thin, are sharp and dangerous (particularly in water, where human skin can easily be cut).

SUMMARY OF THE INVENTION

The object of the present invention is to eliminate the problems listed above and this object is achieved by virtue of the fact that the blade of the flipper according to the invention has a partially multi-layered structure including a base layer made of the aforesaid fairly rigid thermoplastic material and an outer layer superimposed on the base layer, at least on the upper face of the blade and extending over between 15 and 90% thereof, the outer layer being made of a material which is more resilient than the material of the base layer and which returns to its undeformed condition more quickly, and being connected permanently to the base layer by chemical-thermal adhesion.

In general terms, the multi-layered conformation of the blade affords a series of structural, functional and aesthetic advantages to a degree which depends to a greater or lesser extent on the composition, arrangement and extent of the outer layer applied to the base layer.

In the first place, the blade has the optimum resilient behaviour for swimming propulsion; the fairly rigid, only slightly extensible, and fairly inflexible base layer constitutes the geometric core which provides the flipper with a precise shape. The dynamic function of the blade is fulfilled substantially by the more resilient outer layer, whereby the blade, which is deformed by bending during the swimming motion, is snapped back to its undeformed condition quickly.

Since, in practice, the base layer is not involved in the dynamic functions, it can be thinner, minimising the "viscous braking" effect of the flipper in use. Its reduced thickness also ensures the absence of moulding deformities and allows the cooling cycle after moulding to be accelerated.

A further advantage of the flipper according to the invention is that its working life is extended since the outer resilient layer constitutes an effective protection for the blade against superficial scratching and abrasion. The flipper is also considerably safer in use; in fact, the outer edges which are sharp and usually dangerous are conveniently normally covered by the resilient outer layer.

A further important advantage of the flipper according to the invention lies in greater dimensional stability with variations of temperature in use; in practice, its multi-layered structure, by virtue of which there is a lower percentage of the component (the base layer) whose rigidity varies widely with temperature, means that the blade is unaffected by temperature variations. The dynamic behaviour of the blade thus remains almost unchanged in use either in cold water or in hot water.

Finally, the multi-layered structure of the blade affords an additional advantage of an aesthetic character resulting from an original colour effect due to the contrast between the base layer and the outer layer, and also from the fact that the outer layer may be formed with apertures through which the base layer is visible. The apertures may consist of decorative motifs or inscriptions which cannot normally be formed on conventional flipper blades.

In a preferred embodiment of the invention, the outer layer is made of the same material as the shoe and is moulded over and attached to the blade by chemical-thermal adhesion. This solution makes the flipper particularly simple to manufacture since the multi-layered structure of the blade is actually formed during the moulding of the shoe, simply by extending the moulding of the thermoplastic rubber to preselected regions of the blade as well as the shoe region. In this way, the thermoplastic material (E.V.A.) of the base is truly rubberised. The extent of the rubberising may vary; in order to achieve the functional and aesthetic advantages listed above, the outer layer is normally, but not necessarily, applied only to a substantial part of the upper surface of the blade and to a small part of its lower surface. If the blade has conventional longitudinal stiffening ribs and ridges, these are not covered by the outer layer. The outer edges of the blade, however, are usually covered by the outer layer. The advantages of the invention are thus conferred on the portions of the blade which most need them; the central region which is usually grooved in order to set up a longitudinal water flow to prevent side-slippage, however, is normally of one layer.

It should be noted that the selection of the combination of E.V.A. and thermoplastic rubber to form the base layer and the at least partial outer layer respectively is not absolutely binding; any combination of materials which may be more suitable may be selected.

In order further to increase the dynamic advantages of the flipper, the invention provides for the possible formation of the multi-layered structure of the blade with an at least partial intermediate layer constituted by at least one plate interposed between the base layer and the outer layer. The plate or plates may be of metal, rigid plastics material or similar materials, and may have holes which are penetrated by the material of the outer layer so that it is anchored more firmly to the base layer.

BRIEF DESCRIPTION OF THE DRAWINGS

The invention will now be described in detail with reference to the appended drawings, provided purely by way of non-limiting example, in which.

DETAILED DESCRIPTION OF THE INVENTION

Figure 1:
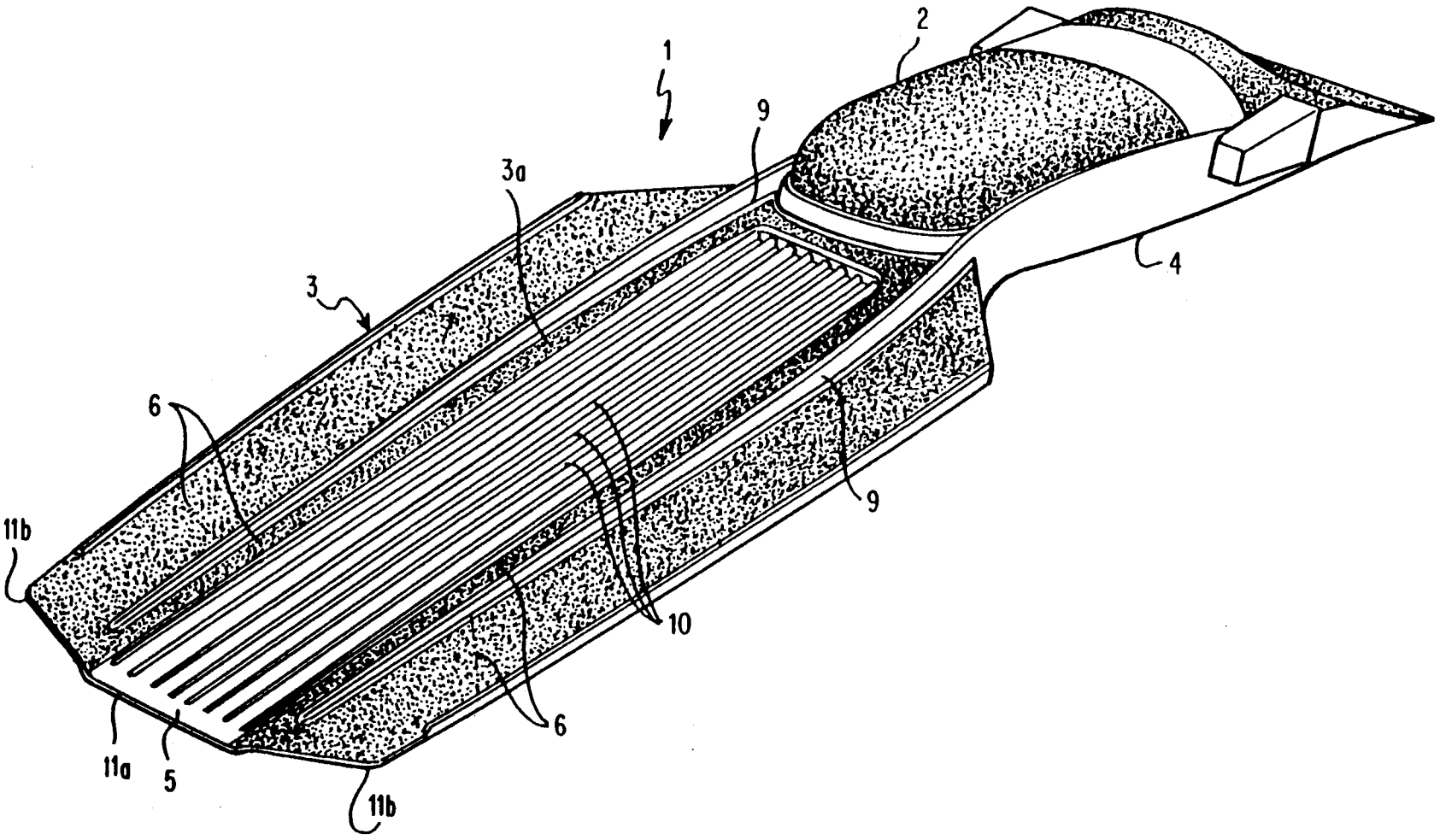
FIG. 1 is a schematic perspective view of a swimming flipper according to a preferred embodiment of the invention.
Figure 2:
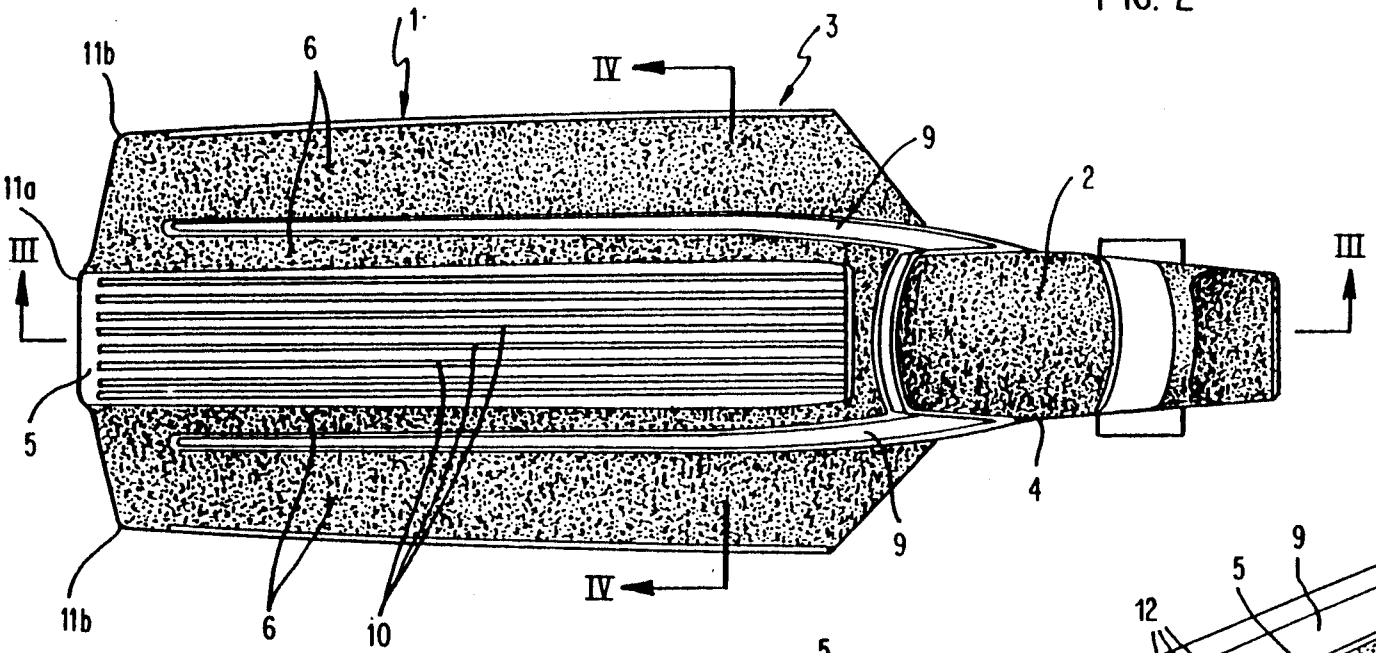
FIG. 2 is a plan view of FIG. 1 on a reduced scale.

In the drawings, a swimming flipper according to the invention, indicated 1, is constituted by a one-piece body defining at one end a shoe 2 which is connected to a composite or multi-layered blade 3.

In the embodiment illustrated, the shoe 2 is intended to be closed at the rear by an adjustable strap, not shown; alternatively, it could be of the type with an integral rear wall. The shoe 2 is made of an elastomeric material or, more conveniently, a soft, resilient thermoplastic rubber. The shoe 2 is attached, in the generally conventional manner which will be described below, to an extension 4 of the blade 3 which constitutes the sole of the shoe 2.

The blade 3 is constituted by a base layer 5 of fairly rigid thermoplastics material which also forms the sole 4 and by a partial outer layer 6 which is superimposed on and, in the manner made clear below, permanently connected to preselected regions of the base layer 5.

The base layer 5 is preferably, but not necessarily, made of ethylene vinyl acetate (E.V.A.). It is formed so as to define a central region 7 of the blade 3 and two lateral strips 8 separated by two longitudinal side elements 9 which project from both the upper face 3*a*and the lower face 3*b* of the blade 3. The central region 7 also has longitudinal ridges 10 projecting from its upper face 3*a* and the lateral strips 8 terminate in respective longitudinal side edges 11. The transverse edge of the blade 3 at the end opposite the shoe 2 is indicated 11*a*.

The material forming the outer layer 6 may be selected from a wide range; it may be a thermoplastic material similar to that forming the base layer 5 but with a different composition and colour or, more conveniently, a material which is more resilient than the thermoplastic material of the base layer 5 and which returns more quickly to its undeformed condition. In the embodiment illustrated, the outer layer 6 is made of the same material as the shoe 2, that is, a soft and resilient thermoplastic rubber. It should be stated that, for the purposes of the manufacture of the flipper 1 in the manner described below, this thermoplastic rubber is selected so as to have a considerable chemical affinity for the thermoplastic material of the base layer 5 and may itself contain a certain percentage of the same thermoplastic material.

The outer layer 6 covers the base layer 5 over most of the upper face 3*a* of the blade 3, covering between 15 and 90%, and preferably between 40 and 60%, thereof in general terms; more particularly, in the embodiment illustrated, it is applied to the two lateral strips 8 and along two portions of the central part 7 between the side elements 9 and the ridges 10. It also surrounds the side edges 11 and covers the immediately adjacent regions of the lower face 3*b* of the blade 3, as well as the corners (11*b*) connecting the edges 11 and the transverse end edge 11*a*. Different arrangements and distributions of the outer layer may be provided for, however, within the scope of the present invention.

Figure 4:
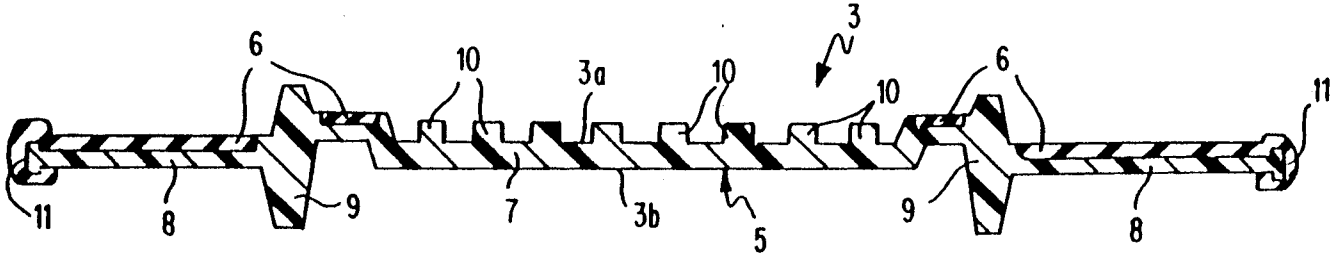
FIG. 4 is a cross-section taken on the line IV—IV of FIG. 2 on an enlarged scale.

As can clearly be seen in FIG. 4, the outer layer 6 is as thick as or is slightly thinner than the regions of the base layer 5 to which it is applied. In general, the thickness of the outer layer 6 may vary between 20 and 200%, and preferably between 40 and 90%, of that of the base layer 5.

In an alternative embodiment of the invention, the outer layer 6 may have a different distribution over the base layer 5 or may even cover it almost completely. For the purposes of aesthetic and functional results (as regards the improved dynamic behaviour of the blade 3 and its protection against scratching and abrasions, as well as its thermal stability), however, the solution shown in FIGS. 1 to 4 is considered preferable.

Figure 6:
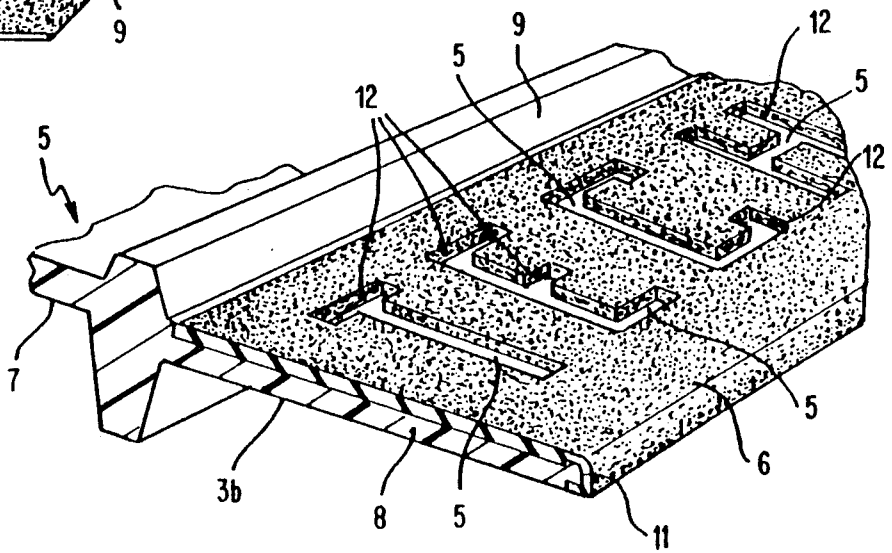
FIG. 6 is a partial perspective view of a further variant of FIG. 4, on an enlarged scale.
Figure 3:
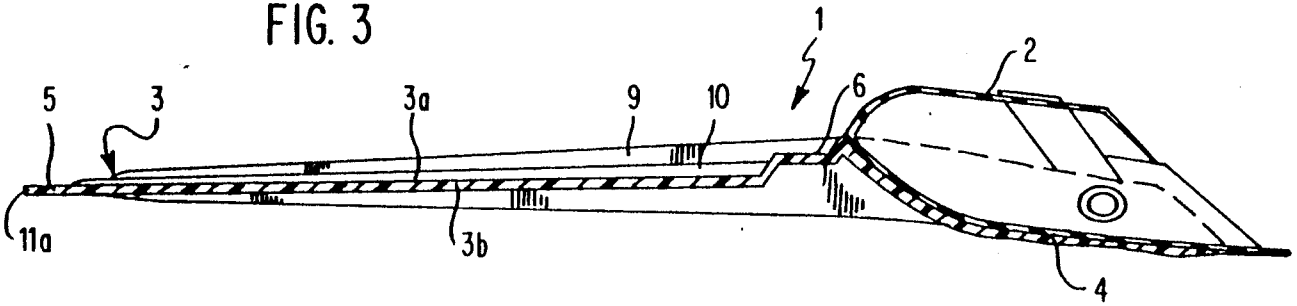
FIG. 3 is a longitudinal section taken on the line III—III of FIG. 2.

The presence of the outer layer 6 also enables the flipper according to the invention to have decorations or inscriptions with an original colour effect; this can be achieved, according to the variant shown in FIG. 6, simply by the formation of apertures 12 through which the base layer 5 is visible externally in preselected regions of the outer layer 6, for example, on the lateral strips 8 of the blade 3. The colour effect is due to the fact that, as stated above, the layers 5 and 6 are conveniently of different colours.

Alternatively, the same effect may be achieved by the formation of the base layer 5 with raised portions which are intended to project from the layer 6 or to be flush therewith.

Figure 5:
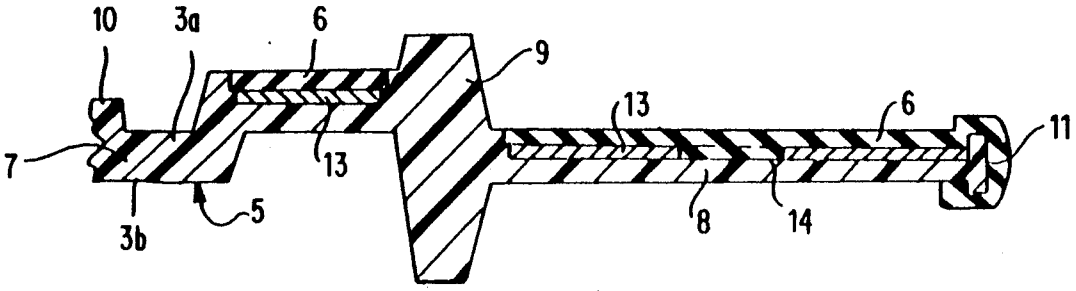
FIG. 5 shows a variant of FIG. 4, on an enlarged scale.

The composite structure of the blade 3 is not limited to only two layers 5, 6; the invention also provides for three or more layers as shown, for example, in FIG. 5. In this embodiment, an intermediate layer constituted by one or more plates 13 of metal, fairly rigid thermoplastic material, or at least a similar material is interposed between the base layer 5 and the outer layer 6. The plates 13, which are not necessarily covered completely by the outer layer 6, may conveniently have through-holes 14 which are penetrated by the material of the outer layer 6 so that it is anchored effectively to the base layer 5.

The main advantages of the flipper 1 according to the invention over conventional flippers may be summarised as follows.

1. Its resilient behaviour is enhanced: the fairly rigid base layer 5 constitutes the geometrical core which provides the flipper with a precise shape. The outer layer 6, if it is made of a more resilient material, and any intermediate plates 13 which return quickly to their undeformed conditions add to the resilience of the base layer 5 and, in use, help to return it quickly and completely from its bent condition to its undeformed condition. This considerably improves the dynamic propulsive action of the flipper 1.
2. The base layer 5 can be thinner, simplifying and accelerating its manufacture by moulding.
3. The easily scratched surface of the base layer 5 is protected.
4. There is a soft coating on the outer edges of the blade 3 which makes them less dangerous when the flipper is in use.
5. Original aesthetic effects are achieved (very varied two-tone or multi-tone effects in any geometrical arrangement in the form of regions, strips, inscriptions or decorations).
6. The flipper is unaffected by temperature the multi-layered structure has greater thermal stability since there is a lower percentage of the component (the base layer 5) whose ridigity varies greatly with temperature.

In order to manufacture the flipper 1 according to the invention, a preferred method provides initially for the use of generally known technology for sticking the shoe 2 to the blade 3. This consists of the moulding of the shoe 2 directly over the appendage 4 of the blade 3 after the base layer 5 has been preformed, for example, by injection moulding. Since, as stated, the thermoplastic material of the base layer 5 has a lower melting point than the thermoplastic rubber of the shoe 2, the thermoplastic rubber is injected into the die at a temperature high enough to melt the surface of the base layer 5 in the regions which are in contact with the shoe 2 and to weld them together by chemical-thermal adhesion.

The outer layer 6 and any intermediate layers 13 may subsequently be applied by any mechanical or chemical means or by gluing or moulding. The essential condition is that, after the outer layer 6 and any intermediate layers 13 have been applied, they are connected permanently to the base layer 5.

If the base layer 6 is made of the same material (thermoplastic rubber) as the shoe 2, the invention provides for the outer layer 6 to be formed during the actual moulding-on of the shoe 2 or by a subsequent moulding-on operation. For this purpose, the thermoplastic rubber is moulded over the base layer 5 on the desired regions of the blade 3, as well as on the region of the shoe 2, and is attached to the base layer 5 by chemical-thermal adhesion.

In order to form any intermediate layer or layers, the plate or plates 13 are inserted in the die before the thermoplastic rubber is moulded. The plates 13 are thus incorporated in the structure of the blade 5 as a result of the formation of the outer layer 6 whose adhesion to the base layer 5 can be made more effective by the presence of any holes 14.

In order to form the apertures 12 which are intended to form inscriptions or decorations, it suffices to use suitable masks of corresponding shapes during the moulding of the outer layer 6.

As stated above, the thickness of the moulded material which constitutes the outer layer 6 is preferably between 20 and 200

% of that of the corresponding region of the base layer 5. The thicknesses of the plates 13 may be of the same order of magnitude or smaller.

Naturally, the details of construction and forms of embodiment of the flipper may be varied widely with respect to those described and illustrated, without thereby departing from the scope of the present invention.

What is claimed is:

1. A swimming flipper including a blade of fairly rigid thermoplastic material having an upper face, a lower face and longitudinal side edges and a shoe of elastomeric material fixed to one end of the blade, said blade having an active portion extending forwardly of said shoe between said longitudinal side edges, said active portion of said blade having an outer layer superimposed at least one the upper face of the blade and extending continuously along said active portion of said blade from said shoe to a second end opposite said shoe over between 15 and 90% thereof, the outer layer being made of a material which is more resilient than the material of the blade and returns to its undeformed condition more quickly, and being connected permanently to the blade by chemical-thermal adhesion.

2. A flipper according to claim 1, wherein the blade has longitudinal ribs and ridges, and a transverse end edge at said second end opposite the shoe, and wherein the outer layer covers the upper face of the blade along two flat longitudinal strips adjacent the side edges, except for the ribs and ridges.

3. A flipper according to claim 2, wherein the outer layer also covers the side edges of the blade, immediately adjacent regions of said lower face, and corner regions between the side edges and the transverse end edge.

4. A flipper according to claim 1, wherein the shoe is moulded on said one end of the blade and the outer layer is made of the same material as the shoe and is moulded over the active portion of said blade.

5. A flipper according to claim 1, wherein the outer layer has apertures through which the active portion of said blade is visible.

6. A flipper according to claim 1, wherein a partial intermediate layer constituted by at least one plate is interposed between the active portion of said blade.

7. A flipper according to claim 6, wherein the at least one plate is of metal.

8. A flipper according to claim 6, wherein the at least one plate is of plastics material.

9. A flipper according to claim 6, wherein the at least one plate has holes which are penetrated by the material of the outer layer.

10. A flipper according to claim 1, wherein the outer layer has a thickness of between 20 and 200% of the thickness of the active portion of said blade.

11. A flipper according to claim 1, wherein the active portion of said blade and the outer layer are of different colours.

12. A method of manufacturing a swimming flipper including forming a blade of fairly rigid thermoplastic material having an upper face, a lower face and longitudinal side edges, and a shoe of elastomeric material, attaching said shoe to one end of the blade, said blade having an active portion extending forwardly of said shoe between said longitudinal side edges, superimposing an outer layer at least one the upper face of the blade which extends continuously along said active portion of said blade form said shoe to a second end opposite said shoe over between 15 and 90% thereof, the outer layer being made of a material which is more resilient than the material of the blade and which returns to its undeformed condition more quickly, and being connected permanently to the blade by chemical-thermal adhesion.

13. A method according to claim 12, wherein the blade has longitudinal rigs and ridges, and a transverse edge at said second end opposite the shoe, and wherein the outer layer is formed so as to cover the upper face of the blade along two flat longitudinal strips adjacent the side edges, except for the ribs and ridges.

14. A method according to claim 13, wherein the outer layer is formed so as also to cover the side edges of the blade, immediately adjacent regions of said lower face, and corner regions between the side edges and the transverse end edge.

15. A method according to claim 12, wherein the blade is pre-moulded and the shoe is then moulded directly onto the blade and is welded thereto by chemical-thermal adhesion due to being molded thereon, the outer layer being made of the same material as the shoe and being moulded over the active portion of the blade.

16. A method according to claim 12, wherein the outer layer is formed with apertures through which the active portion of the blade is visible.

17. A method according to claim 12, wherein the outer layer is formed with a thickness of between 20 and 100% of the thickness of the active portion of the blade.

18. A method according to claim 12, wherein the material of the blade is ethylene vinyl acetate.

19. A method according to claim 15, wherein, before the material of the shoe is moulded, at least one plate element intended to constitute at least one intermediate layer of the multi-layered structure is applied to the blade.

20. A method according to claim 19, wherein the at least one plate element is of metal.

21. A method according to claim 19, wherein the at least one plate element is of plastics material.

22. A method according to claim 19, wherein the at least one plate element is formed with holes which are penetrated by the material of the outer layer as a result of its moulding.

23. A method according to claim 12, wherein the blade and the outer layer are of different colours.

* * * * *